United States Patent [19]

Suzuki

[11] Patent Number: 4,473,303

[45] Date of Patent: Sep. 25, 1984

[54] ELECTRONIC TIMEPIECE

[75] Inventor: Fuminori Suzuki, Tanashi, Japan

[73] Assignee: Citizen Watch Company Limited, Tokyo, Japan

[21] Appl. No.: 468,002

[22] Filed: Feb. 18, 1983

[30] Foreign Application Priority Data

Feb. 19, 1982 [JP] Japan ..... 57-25700
Mar. 26, 1982 [JP] Japan ..... 57-48630

[51] Int. Cl.[3] ..... G04B 17/12; G04B 17/20
[52] U.S. Cl. ..... 368/201; 368/202
[58] Field of Search ..... 368/155, 156, 200–202; 331/176

[56] References Cited

U.S. PATENT DOCUMENTS 3,978,650 9/1976 Hashimoto et al. ..... 368/202
4,272,840 6/1981 Morozumi et al. ..... 368/202
4,321,698 3/1982 Gomi et al. ..... 368/200

*Primary Examiner*—Vit W. Miska
*Attorney, Agent, or Firm*—Jordan and Hamburg

[57] ABSTRACT

An electronic timepiece is provided with a temperature compensation system which combines precise control of the timebase oscillator circuit frequency over a narrow temperature range with control of the frequency divider circuit operation to provide relatively large step changes in compensation, thereby providing accurate temperature compensation over a very wide temperature range. Data for control of this compensation is produced by computing the square of a data value which varies proportionally with temperature, with the resultant data being adjusted to provided compensation control which exactly matches the temperature characteristic of the timebase oscillator circuit.

10 Claims, 10 Drawing Figures

QUARTZ CRYSTAL OSCILLATOR CIRCUIT 1

11
12
13
14
15
2
2a
2b
2c
3
F1
P7
F10 F12 F14 F16
P8
F9 F11 F13 F15
7
7a
7b
COINCIDENCE DETECTION CIRCUIT
8
8a
8b
8c
8d
8e
8f
8g
8h
8i
F13
F14
F15
F16
6
6a
COMPENSATION DATA REGISTER
COMPUTATION SECTION
6b
5a
5b
5c
5d
F2
ADDITION COUNTER
GATE SIGNAL COUNTER
9a
9b
K1
K2
TEMPERATURE COMPENSATION CIRCUIT 4
TEMPERATURE MEASUREMENT CIRCUIT 5

QUARTZ CRYSTAL OSCILLATOR CIRCUIT 1

11
12
14
13
15
2
3
F1
F1'
2a
2b
2c
P7
F10 F12 F14 F16
F16 F14 F15
P8
8
F9 F11 F13 F15
7
F15 F14
8d
8a
7a
EQ
DA
DB
7b
8b
8e
8f
8c
26
C2
28
C2
F13
F4
22d
22c
22
22b
C1
24
22f
22e
24c
K3
22a
24b
23a
PERIOD MEASUREMENT CIRCUIT
K2
K1
23b
24a
TEMPERATURE COMPENSATION CIRCUIT 21
TEMPERATURE MEASUREMENT CIRCUIT 23

ELECTRONIC TIMEPIECE

BACKGROUND OF THE INVENTION

The present invention relates to a temperature compensated electronic timepiece having a temperature compensation circuit which is implemented as a monolithic integrated circuit formed of MOS transistors.

Hitherto, there have been a number of proposals for methods of performing temperature compensation of a standard frequency signal source in an electronic timepiece by sensing the ambient temperature, utilizing a temperature sensing circuit mounted in the timepiece. However, such proposals have not been put into practice to any considerable degree, due to such factors as the increased number of components required, and complexity of adjustment. However in recent years, timepiece users have become aware of the high degree of accuracy that can be obtained from an electronic timepiece employing a quartz crystal oscillator circuit. Thus, if a user owns a number of such timepieces, he will expect the same degree of timekeeping accuracy from a timepiece which is actually worn as from a timepiece which is not worn, but for example is left inside a desk. In addition, a high degree of accuracy will be expected even if a timepiece is left unused for a long period of time. In view of such requirements, temperature compensation will be necessary, and there is therefore a requirement for a low-cost temperature compensation circuit to be developed.

Prior art methods of temperature compensation include the capacitor temperature compensation method, and the method of using an expensive AT-cut quartz crystal vibrator which has a good frequency/temperature characteristic in a high-frequency oscillator circuit used as a timebase signal source. In addition, a method has recently been developed whereby two low-frequency tuning-fork type quartz crystal vibrator elements having different temperature characteristics are used to provide temperature compensation in an electronic timepiece. However, with the latter new method, the temperature compensation range is narrow, i.e. from 0° C. to 40° C., while if it is attempted to provide a wider range of temperature compensation, then as a result of the need to apply a close degree of compensation control to the frequency divider circuit of the timepiece, the temperature compensation cycle time (i.e. the duration of each repetitively performed temperature compensation operation) will become excessively long. Thus, this method has the disadvantage that it is necessary to use special measurement equipment in order to measure the timekeeping rate accuracy. Generally speaking, the gate time of the generally used type of timekeeping rate measurement equipment can be selected to be in the order of 2 seconds, or 4 seconds, or in some cases as much as 10 seconds, and the temperature compensation operation cycle time of a timepiece whose timekeeping rate is to be measured must match this gate time of the rate measurement equipment. If this cannot be achieved, then considerable inconvenience will result, with regard to after-sales service, and due to the fact that the timepiece will not be suitable for mass production manufacture. In addition, in the case of a temperature compensation method which uses a frequency difference between two quartz crystal vibrator elements, noise can result due to mutual interference between the two oscillator circuits. In order to avoid this, the circuits must be spaced a substantial distance apart, and as a result, the two oscillator circuits will not reach a common temperature equilibrium state. Thus, temperature data produced thereby may be erroneous.

Another problem which has arisen is with regard to the method of controlling the timekeeping rate of the timepiece in accordance with some measured compensation quantity which varies with temperature. One method is to control the frequency of oscillation of a quartz crystal oscillator circuit used as standard frequency signal source, by periodically connecting a capacitor to this oscillator circuit during time intervals whose duration (i.e. duty cycle) is controlled in accordance with the compensation quantity. However although such a method provides extremely precise control of the timekeeping rate, the maximum amount of temperature compensation that can be achieved is determined by the amount of capacitance which can be switched in this away. In order to make the range of temperature compensation sufficiently wide, it is necessary to make the amount of switched capacitance large. However if this is done, then the optimum conditions for operation of the quartz crystal oscillator circuit cannot be met, so that it is not possible to simultaneously provide optimum operation of the quartz crystal oscillator circuit and also provide a wide range of temperature compensation.

It is an objective of the present invention to overcome the problems described above, and to provide temperature compensation over a wider temperature range than has been possible in the prior art, and to provide a temperature compensated electronic timepiece whose timekeeping rate measurement and adjustment can be carried out using timekeeping rate measurement equipment in the same way as a conventional electronic timepiece, at the time of dispatch from the factory or in a retail store. Such a timepiece is easy to use, and highly suited to mass production manufacture.

SUMMARY OF THE INVENTION

An electronic timepiece provided with temperature compensation according to the present invention is provided with a temperature compensation circuit having a temperature sensor comprising a temperature sensing oscillator circuit formed of MOS transistors, whose frequency of oscillation varies linearly with respect to temperature, this temperature sensing oscillator circuit being formed within the same integrated circuit chip as the timekeeping circuits of the timepiece. In addition, the quartz crystal vibrator of the timepiece standard frequency oscillator circuit is sealed upon the circuit substrate on which the latter IC chip is mounted, so that a state of common temperature equilibrium is reached by the temperature sensor and by the quartz crystal vibrator. Furthermore, a timepiece according to the present invention is provided with first compensation means for providing a very precise degree of temperature compensation by controlling the frequency of oscillation of the timebase oscillator, i.e. quartz crystal oscillator circuit, and second compensation means for providing discrete large steps of temperature compensation by controlling the effective frequency division ratio of the timepiece frequency divider circuit. By combining these two types of compensation control, precise compensation of the frequency/temperature characteristic of the timepiece quartz crystal oscillator circuit is provided over a very wide range of temperatures, with temperature compensation operations being performed within a short measurement cycle time.

In an electronic timepiece according to the present invention, the oscillation frequency of the quartz crystal oscillator circuit is controlled by first compensation means, while the effective frequency division ratio of the frequency divider circuit which frequency divides the output signal from the quartz crystal oscillator circuit is controlled by second compensation means. The first compensation means preferably control the duty cycle of control pulses which are periodically applied to an electronic switch to connect a capacitor to the quartz crystal oscillator circuit, thereby lowering the frequency of oscillation for the duration of each of the latter control pulses.

The second compensation means preferably generate control pulses which control a gate circuit coupled between stages of the frequency divider circuit, such as to effectively inject additional pulses into the output from the latter gate circuit, with the number of pulses thus injected being determined by the number of the latter control pulses.

The period of the oscillation signal produced by the temperature sensing oscillator circuit is measured and digital data representing the value of that period is generated. This data is then appropriately modified, by for example addition of a presettable data value thereto, such as to provide temperature compensation to match the characteristics of the particular timepiece components involved, and the resultant value is then squared by a computation circuit. A digital data value is thereby generated whose bits (below the most significant bit) represent a numeric value which varies with temperature in exactly the inverse manner to the frequency/-temperature characteristic of the timepiece quartz crystal oscillator circuit. A plurality of the more significant bits of this data value are then applied to the first control means (to produce control pulses therefrom whose duty ratio varies in proportion to the numeric value represented by the latter more significant bits) and a plurality of the lesser significant bits are applied to the second control means (to produce a number of pulses within each of a succession of time intervals of fixed duration, the number of these pulses in such a time interval being determined by the numeric value represented by the lesser significant bits).

Presettable numeric data values are stored in a memory circuit section, and these values can be adjusted to provide an optimally flat temperature characteristic for the timekeeping rate of the timepiece, these numeric data values being input to the computation circuit and possibly also to the circuit which measures the period of the temperature sensing oscillator signal.

In this way, precise temperature compensation of the second-order curvature temperature characteristic of the quartz crystal oscillator circuit is provided by components which are all formed within the IC chip containing the timekeeping circuits etc, of the timepiece, with it being unnecessary to provide external components such as thermistors. In addition, all adjustment can be performed by varying the preset numeric data values, eliminating even the need to adjust a trimmer capacitor. Thus, all adjustment and setting up of such a timepiece can be performed by automatic equipment, ensuring a high degree of suitability for mass production manufacture.

DESCRIPTION OF THE PREFERRED EMBODIMENTS

Figure 1:
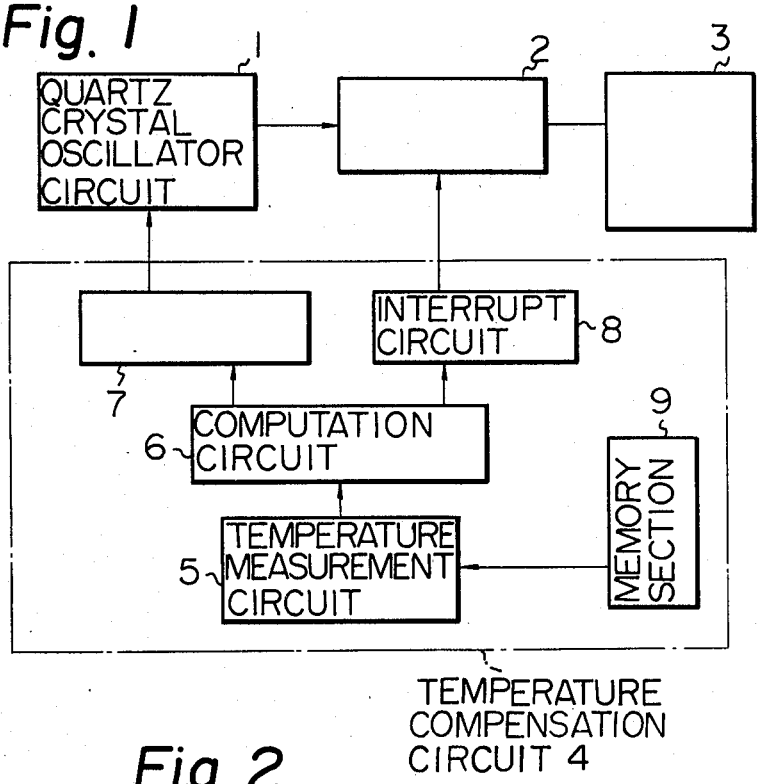
FIG. 1 is a block diagram of a first embodiment of the present invention.

The present invention will now be described with reference to the drawings. FIG. 1 is a block circuit diagram of a first embodiment of an electronic timepiece according to the present invention. Numeral 1 denotes a quartz crystal oscillator circuit whose frequency of oscillation can be changed between two different frequencies by means of an electronic switch which changes over the value of oscillator circuit capacitance. Numeral 2 denotes a frequency divider circuit, which serves to frequency divide the output signal from quartz crystal oscillator circuit 1, and also is provided with an interrupt gate which enables the signal output from an intermediate frequency divider circuit stage to be selectively inverted. Numeral 3 denotes a timekeeping circuit, for producing timekeeping signals from the output signal produced by frequency divider circuit 2, and for producing output signals to provide a time display. Numeral 4 denotes a temperature compensation circuit, which applies control signals to the electronic switch in quartz crystal oscillator circuit 1, and to the interrupt gate of frequency divider circuit 2.

The circuit sections which constitute temperature compensation circuit 4 are as follows. Numeral 5 denotes a temperature measurement circuit which includes a temperature sensing oscillator circuit, and produces digital data as output representing a numeric value which varies in proportion to temperature. Numeral 6 denotes a computation circuit for converting the data value produced from temperature measurement circuit 5 to thereby produce numeric data as output whose value is a second order function of temperature. Numeral 7 denotes a duty ratio control circuit which references part of the data output from computation circuit 6 to thereby transmit a control pulse signal to the electronic switch of quartz crystal oscillator circuit 1. This duty ratio control circuit, in combination with the latter electronic switch, constitutes first compensation means. Numeral 8 denotes an interrupt circuit which references another part of the output data from computation circuit 6, and thereby transmits an interrupt control signal to the interrupt gate in frequency divider circuit 2. This interrupt circuit, in conjunction with the latter interrupt gate, constitutes second compensation means. Numeral 9 denotes a memory section, for storing numeric data values which control the operating condition of temperature measurement circuit 5.

These numeric values can be set into memory section 9 by external means.

The operation of the circuit of FIG. 1 will now be described. The circuit configuration is such that, when a control signal at the low logic level is applied to quartz crystal oscillator circuit 1 from duty ratio control circuit 7, a lower frequency of oscillation is produced by quartz crystal oscillator circuit 1, while when a high logic level signal is applied, a higher frequency of oscillation is produced. In this way, the first control means control the frequency of oscillation of quartz crystal oscillator circuit 1.

Furthermore, each time a control signal pulse is output from interrupt circuit 8, an additional pulse is effectively inserted into a train of pulses being frequency divided in frequency divider circuit 2. In this way, the effective frequency division ratio of frequency divider circuit 2 is controlled by the second control means.

The timekeeping circuit 3 performs the usual type of timekeeping operations on a continuous basis. However temperature measurement circuit 5 and computation circuit 6 operate on a periodic intermittent manner, i.e. during periodically repeated intervals of fixed duration, which will be referred to as compensation operation intervals. When one of such intervals begins, the temperature sensing oscillator circuit in the temperature measurement circuit is set into oscillation, and the period of the resultant oscillation signal is measured. The numeric data value from memory section 9 is multiplied or added to that measured value. The result of this computation is output as a digital data value. The computation circuit 6 serves to perform squaring of this digital data value, to convert this into a second-order function of temperature, whose temperature characteristic increases symmetrically about a central value. Various digits of the computation results are output to different circuits. More specifically, the most significant digit is output to interrupt circuit 8, and a plurality of digits of successively lower significance thereto are output to the duty ratio control circuit 7. The interrupt circuit 8 references the most significant digits of the result of the squaring computation, and acts to perform a number of inversion operations by interrupt gate in frequency divider circuit 2 by a number of times (during each compensation operation interval) which is proportional to the numeric value represented by the latter most significant digit. The duty ratio control circuit 7 references the least significant digits of the squaring computation result, and applies pulses whose width is proportional to the value represented by the latter digits to the electronic switch of quartz crystal oscillator circuit 1. The cycle time of each compensation operation interval of interrupt circuit 8 and duty ratio control circuit 7 is 2 seconds. Thus, the average timekeeping rate during such an interval will be equal to the average timekeeping rate of the timepiece over an infinitely long time period, so that the timekeeping rate of such a timepiece can be measured using measurement equipment having a gate time of 2 seconds, i.e. by using the usual type of such equipment.

Figure 2:
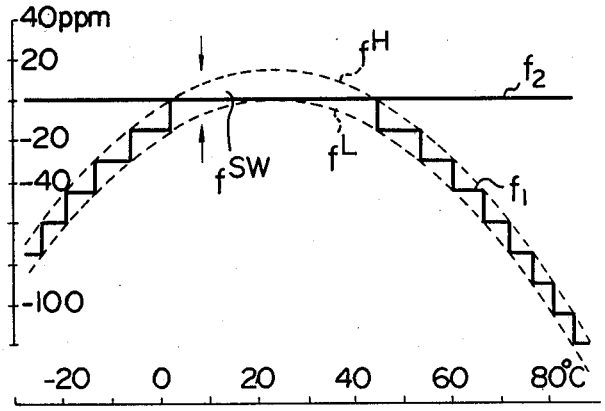
FIG. 2 is a diagram illustrating a temperature compensation characteristic produced by the present invention.

FIG. 2 is a diagram showing the temperature compensation characteristic of a temperature compensation circuit according to the present invention. f1 denotes the characteristic for the case in which only the first compensation means is in operation. As shown, the second-order curvature characteristic of the quartz crystal oscillator circuit is converted into a step-type characteristic, with a very close degree of compensation being applied within each step. f2 denotes the temperature compensation characteristic for the case in which both the first and second compensation means are in operation. In this case, the step form of the characteristic produced by the first compensation means is further modified by the second compensation means to provide a flat temperature characteristic over a wide temperature range. Also in FIG. 2, the two broken-line curves fL and fH represent frequency deviations corresponding to the lower and higher frequencies of oscillation of quartz crystal oscillator circuit 1, i.e. the frequency of oscillation when the control signal from the first compensation means causes the electronic switch in quartz crystal oscillator circuit 1 to connect a capacitor to that circuit (as described hereinafter) and the frequency of oscillation when the latter capacitor is disconnected from the quartz crystal oscillator circuit, respectively. The difference between these two frequency deviations (hereinafter referred to as the frequency changeover deviation fSW) is almost constant with respect to changes in temperature. In the present embodiment, this frequency changeover deviation has a value of approximately 15 ppm. Thus, each of the frequency deviation steps of characteristic f1 is equal to 15 ppm, and the second compensation means (comprising interrupt circuit 8) performs compensation with a step resolution of $\frac{1}{2}^{16}$, i.e. 15.259 ppm, to thereby precisely compensate for the frequency deviation steps in characteristic f1.

Figure 3:
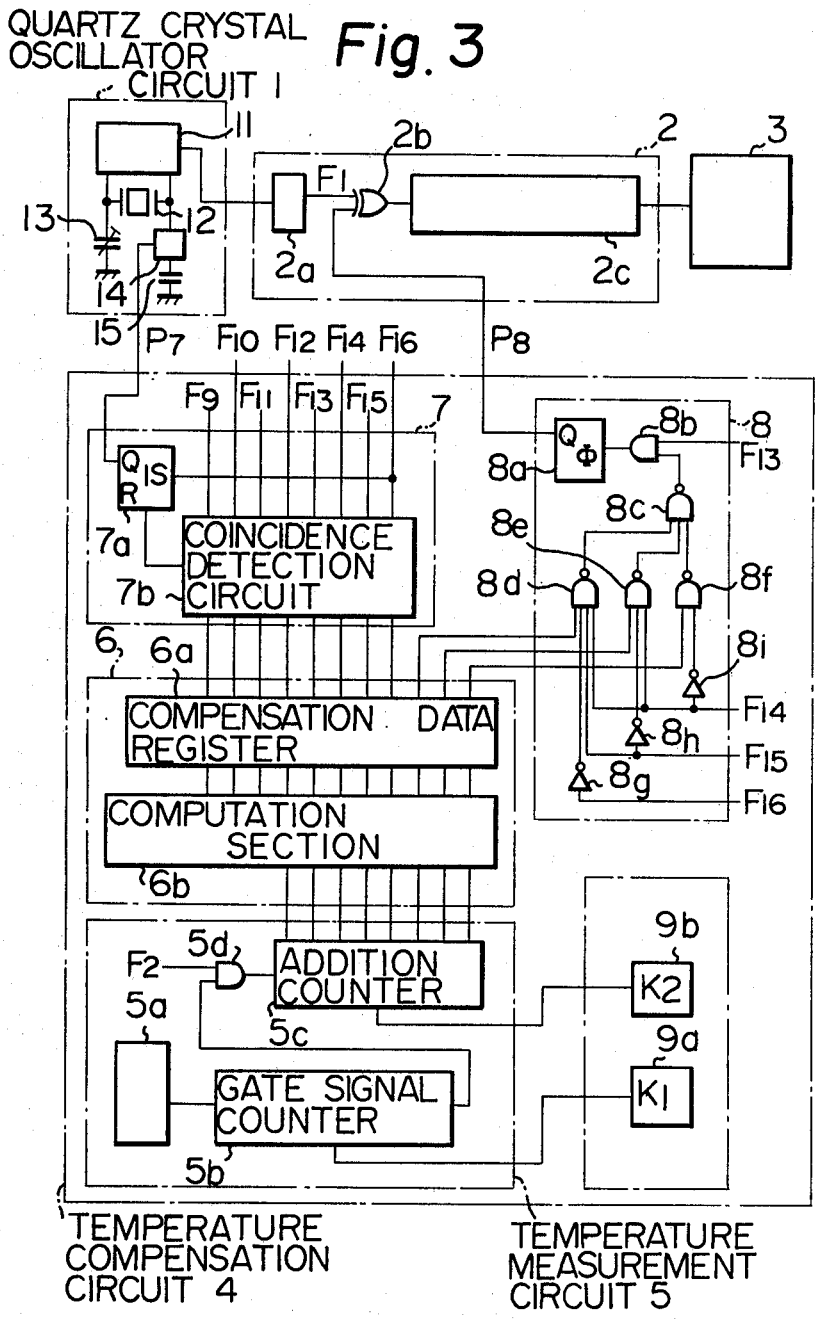
FIG. 3 is a detailed circuit diagram of the first embodiment.

FIG. 3 is a block circuit diagram for describing the embodiment of FIG. 1 in greater detail. The quartz crystal oscillator circuit 1 comprises an oscillation circuit 11, made up of an oscillation inverter etc, coupled to a quartz crystal vibrator 12. A capacitor 15 can be selectively coupled to one end of quartz crystal vibrator 12, while a trimmer capacitor 13 is coupled to the opposite end of quartz crystal vibrator 12. This selective coupling is performed by an electronic switch 14.

Frequency divider circuit 2 comprises a frequency divider circuit section **2*a*, which performs $\frac{1}{2}$ frequency division of the output signal from quartz crystal oscillator circuit 1, an interrupt gate 2*b* which serves to selectively invert the output signal F1 from frequency divider circuit section 2*a* under the control of an externally supplied control signal P8, and a frequency divider circuit section 2*c* which performs further frequency division of the output signal from the interrupt gate 2*b*, to thereby produce a unit time signal. This is supplied to the timekeeping, display drive and decoder circuits of the timepiece, and hence to the display device, which are collectively indicated by block 3**.

The operation of temperature compensation circuit 4 will now be described. In temperature compensation circuit 4, temperature measurement circuit 5 comprises a temperature sensing oscillator circuit **5*a*, formed of MOS FETs, etc, and a gate signal counter circuit 5*b* which receives the oscillation signal produced from temperature sensing oscillator circuit 5*a*, and multiplies the period of the oscillation signal by a first digital data value K1 output from first memory circuit 9*a* in memory section 9 (described hereinafter), to thereby output a gate signal comprising pulses whose pulse width is proportional to the oscillation signal period. The temperature measurement circuit 5 further comprises a gate circuit 5*d* which controls the transfer of the frequency divided signal F2 from frequency divider circuit 2, and an addition counter circuit 5*c* which counts pulses of signal F2 transferred by gate circuit 5*d*, and also adds to the count result attained thereby a second digital data value K2 which is output from a second memory circuit 9b in memory section 9. An 8-bit digital data value which is left in addition counter circuit 5c after this addition operation constitutes the temperature data, which is transferred to computation circuit 6. The computation circuit 6 comprises a computation section for producing the square of the temperature data value, to thereby produce compensation data, and a compensation data registor 6a which stores the compensation data while computation operations are in progress. The overall compensation quantity applied as a result of compensation data follows a second-order curvature temperature characteristic, which is the exact inverse of the frequency/temperature characteristic of quartz crystal oscillator circuit 1**.

The most significant bit of the temperature data bits is used to make a left/right decision, in order to establish symmetrical positioning of the temperature characteristic with respect to the minimum point of the characteristic curve, while the remaining 7 bits are squared. The result of this squaring operation, comprises a 14 bit digital data value, of which 11 bits are sufficient for use as compensation data. In the present embodiment, therefore, the compensation data register 6a has 11 bits, as shown in FIG. 3. The most significant 3 bits of the data in this register 6a are input to the interrupt circuit 8, while the remaining 8 bits are input to duty ratio control circuit 7. The lower significance 8 bits will be designated in the following as the first compensation data, and the upper significance 3 bits will be designated as the second compensation data. The duty ratio control circuit 7 contains a coincidence detection circuit 7b, which detects coincidence between the first temperature data and the digital data value represented by the 8 bit signals F9 to F16 which are output from frequency divider circuit 2, and moreover comprises FF7a, which is triggered into the set state on the negative edge of pulses of signal F16, and is reset by the coincidence signal from coincidence detection circuit 7b. Thus, duty ratio control circuit 7 produces one pulse every 2 seconds. The first compensation data can take values in the range Ø to 255, so that the duty ratio of the output pulses (designated as signal P7) from duty ratio control circuit 7 being at the high logic level is in the range Ø to 255/256. These pulses control electronic switch 14 of quartz crystal oscillator circuit 1, to coupled capacitor 15 to quartz crystal oscillator circuit 1 during time intervals determined by the duty ratio of these P7 pulses. In this way, temperature compensation operations are periodically performed with the very short cycle time of 2 seconds.

Interrupt circuit 8 comprises NAND gates 8a to 8f, which respectively receive as input signals the three bit signals of the second compensation data, inverters 8g to 8i which serve to invert signals F16 to F14 respectively, with the inverted signals being input to NAND gates 8a to 8f, respectively, a NAND gate 8c which receives as input the output signals from NAND gates 8a to 8f, an AND gate 8b which receives as input signals the output from NAND gate 8c and frequency divider circuit output signal F13, and a toggle-type flip-flop FF8a whose output signal level is inverted on each negative-going edge of the output signal from AND gate 8b. The frequency divider circuit output signals F14, F15 and F16 have frequencies of 2 Hz, 1 Hz and 0.5 Hz respectively. Signal F14 is input to inverter 8i and to NAND gates 8a and 8e. Signal F15 is input to inverter 8h and to NAND gate 8a, and signal F16 is input to inverter 8g. As a result, the number of times that signal P8 (produced from interrupt circuit 8) is inverted during a 2-second interval, i.e. the number of compensation operations in that interval, is equal to the numeric value represented by the 3 bits of the second compensation data. Control signal P8 is input to interrupt gate 2b of frequency divider circuit 2, and acts to invert the 16384 Hz signal F1 (i.e. each time control signal P8 goes to the high logic level, signal F1 is inverted by interrupt gate 2b), so that each compensation the minimum compensation amount thereby applied during each compensation operation interval corresponds to 15.26 ppm. This enables a maximum degree of compensation of 106.8 ppm to be applied.

Figure 4:
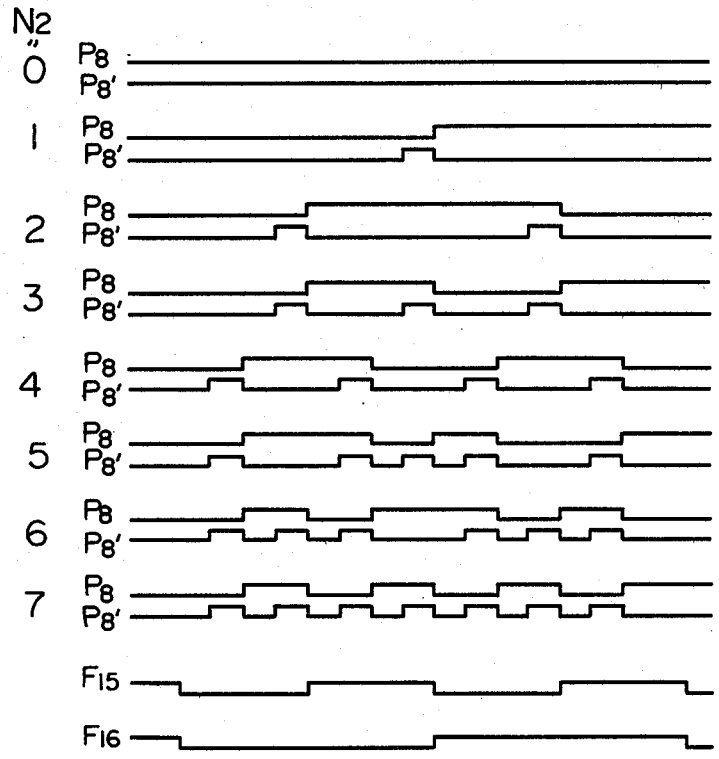
FIG. 4 is a timing chart for the first embodiment.

FIG. 4 is a timing chart showing the waveforms of compensation signal P8 from the second compensation means. For the purpose of reference, the input signal applied to FF8a, which produces signal P8, is also shown, designated as P8'. In addition, to show the relationship between these signals and the timepiece operation, the 1 Hz frequency divider circuit output signal F15 and the 0.5 Hz signal F16 are also shown. The number of times that signal P8 is inverted depends upon the value of the second compensation data, and as show in FIG. 4, the number of inversions of this signal during a 2 second interval is equal to the value N2 of the second compensation data.

Figure 5:
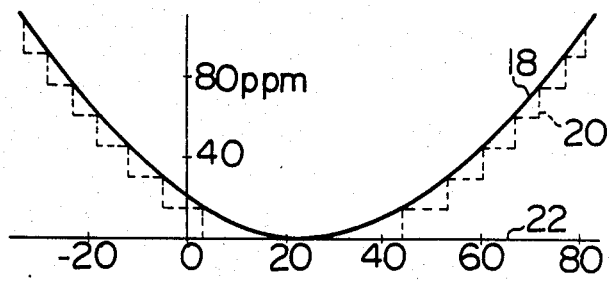
FIG. 5 to FIG. 7 are temperature characteristics provided to describe the temperature compensation operation of the present invention.

FIG. 5 is a diagram showing the compensation characteristic for the case of suitable values having been set into memory section 9, with the temperature data from temperature measurement circuit 5 being matched to the temperature characteristic of quartz crystal oscillator circuit 1. The stepwise portions indicated by broken lines represent the characteristic are computed to be such that a suitable value is provided for the compensation quantity, at a point corresponding to a lower temperature than that of the minimum in the temperature characteristic curve, and also at a point corresponding to a higher temperature than the minimum point of the temperature characteristic curve, while ensuring that the compensation quantity becomes zero at a point which is intermediate between the two points referred to above.

Figure 6:
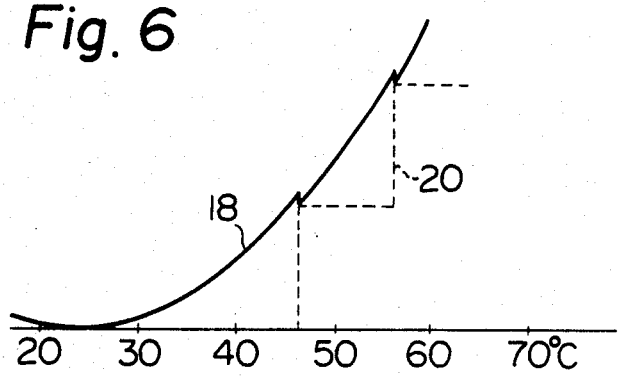

FIG. 6 shows the compensation char for the case in which the changeover frequency deviation fSW is approximately 1 ppm greater than the interrupt frequency deviation fP, so that the matching between the first and second compensation means is not perfect. However, by selecting suitable values for the numeric data values set into memory section 9, it is possible to position the compensation error resulting from this mismatch such as to vary between an advancement error (resulting in advancement of the timekeeping rate beyond the correct rate) and a retardation error (resulting in a retardation of the timekeeping rate below the correct rate).

Figure 7:
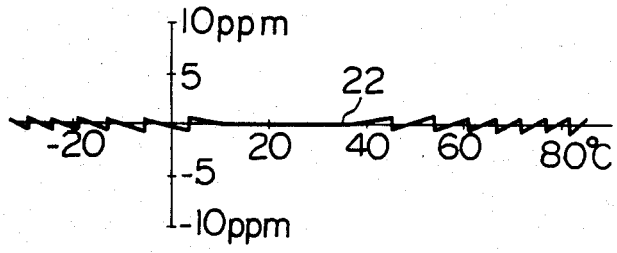

FIG. 7 shows the temperature characteristics for the case of the imperfect compensation match condition shown in FIG. 6. As can be seen, even in this case, a very high accuracy is obtained for the timepiece temperature characteristic.

Figure 8:
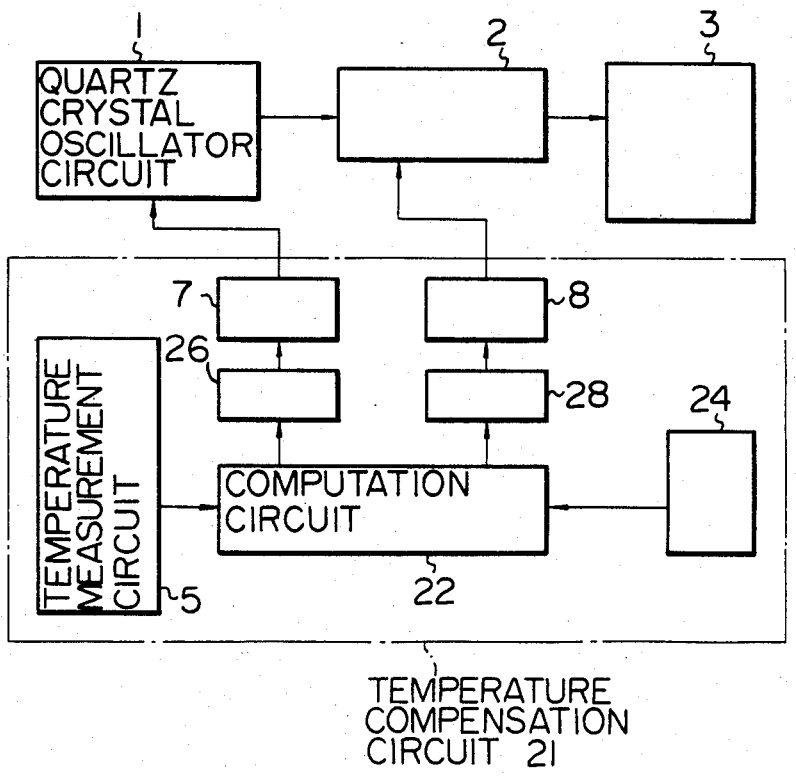
FIG. 8 is a block diagram of a second embodiment.

FIG. 8 is a block circuit diagram of a second embodiment of a temperature compensated electronic timepiece according to the present invention. In this figure, circuit blocks and gates having identical functions to corresponding blocks or gates in the first embodiment described above are denoted by identical reference numerals to those of the first embodiment, and further description will be omitted.

The principal difference between this embodiment and the first embodiment lies in the configuration and operation of the temperature compensation circuit, designated by numeral 21, which will now be described. Numeral 4 denotes a temperature measurement circuit which comprises a temperature sensing oscillator circuit, for producing digital data which varies in proportion to temperature. Numeral 9 denotes a computation circuit provided with squaring means and division means, for producing the square of the temperature data from temperature measurement circuit 5 and for dividing the result of this squaring operation by a predetermined divisor, to thereby produce a quotient and a remainder. Numeral 26 denotes a first register, for storing the remainder computed by computation circuit 22. Numeral 28 denotes a second register, for storing the quotient. Numeral 7 denotes a duty ratio control circuit for sending control pulses to the electronic switch of quartz crystal oscillator circuit 1, while referencing the output data from first register 26. Numeral 8 denotes an interrupt circuit, for sending control signals to the interrupt gate of frequency divider circuit 2, while referencing the output data from the second register 28. The duty ratio control circuit 7, in conjunction with an electronic switch coupled to control the frequency of oscillation of quartz crystal oscillator circuit 1 (as in the first embodiment), constitutes first compensation means. The interrupt gate and interrupt circuit 8 constitute second compensation means.

Temperature measurement circuit 5 and computation circuit 22 operate on a periodic intermittent basis, as in the first embodiment, and serve to measure the period of the output signal from the temperature sensing oscillator circuit in temperature measurement circuit 5, and thereby generate a numeric value. They also serve to multiply the latter numeric value by a predetermined constant or to add a predetermined constant to the latter numeric value, and to output the result as digital numeric data. The computation circuit 22 identifies the sign of the numeric data from temperature measurement circuit 5, represented by the most significant bit of that data, and performs squaring of the data value represented by the bits of lower significance than the most significant bit, then divides the value resulting from the squaring operation by a predetermined constant, to thereby produce numeric data representing the quotient and remainder resulting from this division operation.

First register 26 serves to store the numeric data representing the remainder, while second register 28 stores the numeric data representing the quotient. First register 26 and second register 28 hold the computation results described above stored therein while computation circuit 22 is in operation, and when new computation results are produced, these are stored into registers 26 and 28 at an appropriate timing.

The duty ratio control circuit 7 operates on a 2-second cycle time, and continuously references the data stored in first register 26, to thereby produce one pulse in every 2 second interval, whose pulse width is proportional to the numeric data stored in first register 26. These pulses are applied to control the operation of the electronic switch coupled to quartz crystal oscillator circuit 1. Interrupt circuit 8 operates on a 2-second cycle time, and continuously references the data in second register 28, and performs inversion operations by acting on the interrupt gate of frequency divider circuit 2. The number of inversion operations performed in each 2 second interval is equal to the numeric value represented by the data in second register 28.

As for the first embodiment, a frequency divider output signal of approximately 16 KHz is selectively inverted by an interrupt gate in response to the interrupt signal pulses output from interrupt circuit 8, so that each interrupt operation results in an amount of compensation equivalent to 15.26 ppm.

Figure 9:
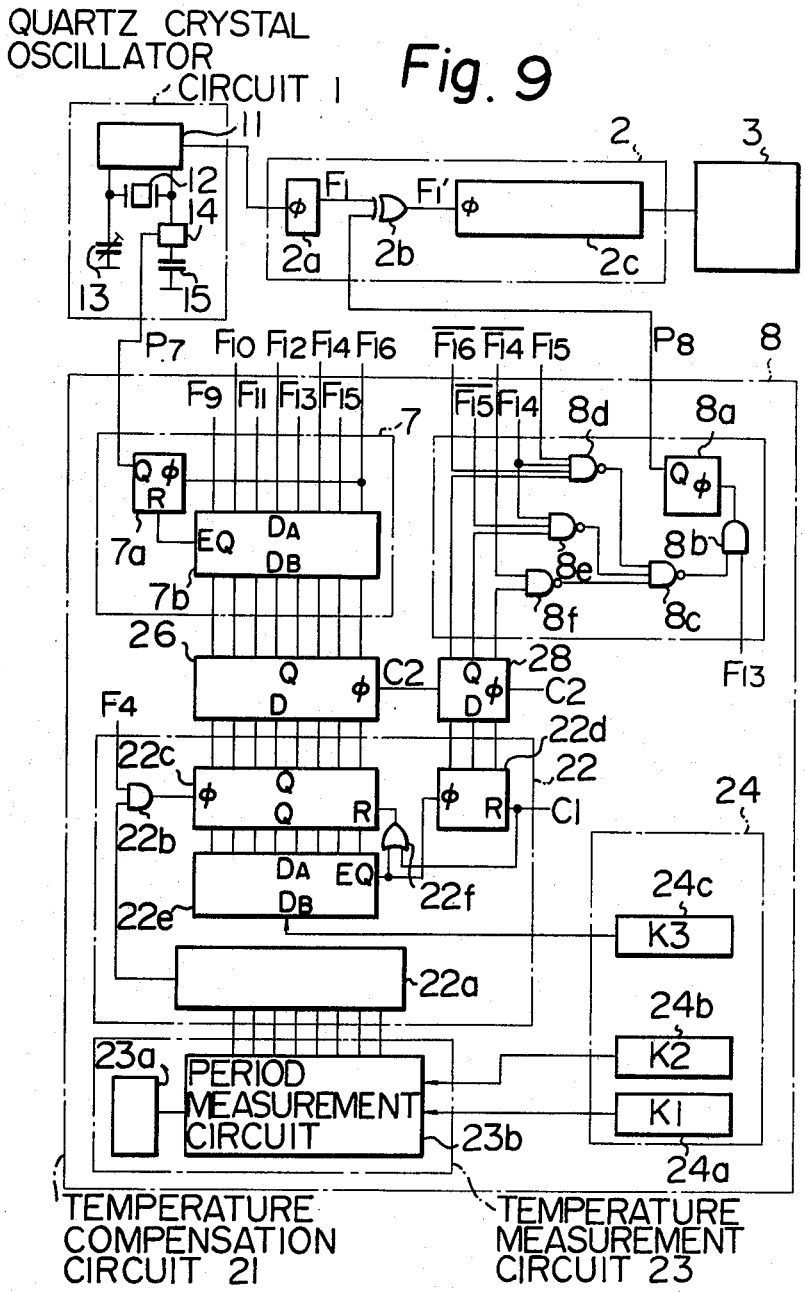
FIG. 9 is a detailed circuit diagram of the second embodiment.

FIG. 9 is a block circuit diagram of this second embodiment, for providing a more detailed description. In temperature compensation circuit 21, temperature measurement circuit 23 comprises a temperature sensing oscillator circuit 23*a*, which is made up of MOS FET transistors, etc, and a period measurement circuit 23*b* which serves to measure the period of the output signal produced by oscillator circuit 23*a*, this period being designated hereinafter as t, and to produce a numeric value representing the value of t. Period measurement circuit 23*b* further multiplies this numeric value by a numeric value K1 which is sent as data from a memory section 24 (described hereinafter), adds to the result of this operation the numeric value K2, and then subtracts from the result a predetermined number. The remainder resulting from this operation is output as temperature data T. In the present embodiment, the latter predetermined number is $2^8$, and T comprises 8 bits of data.

The computation circuit 22 comprises squaring means and division means. The squaring means comprise a squaring circuit 22*a* which acts to discriminate the sign of the temperature data T by recognizing the most significant bit of that data, and performs squaring of the remaining 7 bits of the temperature data T, to produce as output a signal P91. This signal comprises pulses whose pulse width is proportional to a 14 bit numeric value which is obtained as a result of the squaring operation. The division means comprise an AND gate 22*b* which receives signal P91 as a gate signal, a first counter circuit 22*c* which receives and counts pulses of a frequency divider signal that is transferred through AND gate 22*b*, a coincidence detection circuit 22*e* which detects coincidence between the count value in first counter circuit 22*c* and the value of numeric data K3 sent from memory section 24 (described hereinafter), to thereby produce a coincidence signal as output, and an OR gate 22*f* which receives the latter coincidence signal and the control signal C1 as input signals and produces an output signal which is applied to the reset terminal of first counter circuit 22*c*. The division means further comprise a second counter circuit 22*d*, which has control signal C1 applied to the reset terminal thereof, and serves to count the pulses of the coincidence signal output from coincidence detection circuit 22*e*.

Numeral 24 denotes a memory section, which stores the preset numeric values K1 and K2, which control the operation of temperature measurement circuit 23, and preset numeric value K3, which controls the operation of computation circuit 22. K1 determines the rate of charge of temperature data T with respect to temperature. K2 is used to perform offset adjustment of temperature data T. K3 designates the divisor used by the division means of computation circuit 22.

First register 26 is an 8-bit latch circuit, into which the count value in counter circuit 22*c* is stored, at a timing determined by control signal C2. The second register 28 is a 3-bit latch circuit, into which the count contents of second counter circuit 22*d* are stored, at a timing determined by control signal C2.

Memory section 24 can comprise a programmable read-only memory (PROM), a fused ROM, or a wiring pattern formed on a substrate which can be selectively open-circuited.

The operation of the circuit of FIG. 9 will now be described in greater detail. The oscillation period t of temperature sensing oscillator circuit 23*a* in temperature measurement circuit 23 varies in proportion to temperature, and can be, for example, $5\times10^{-4}$ seconds at 0° C., and $7\times10^{-4}$ seconds at 50° C. In order to convert the value of t into temperature data T, period measurement circuit 23*b* measures t and produces a corresponding numeric value, then multiplies this numeric value by K1, and adds K2 to the result. Basically, the essential signal utilized in this embodiment to measure t is frequency divider circuit output signal F2. The conversion operation is performed in accordance with the following equation:

$$T=K1\times t\times fF2+K2-256\times m \quad (1)$$

In the above, fF2 is the frequency of frequency divider circuit output signal F2, and m is a positive integer. If it is assumed that, as a result of the above operation, data is produced which contains higher significance bits than the most significant bit of the temperature data T, then m corresponds to the value of these unnecessary higher significance bits. Thus, in effect, t is multiplied by K1, the period is measured by means of signal F2, K2 is added to the result, and then $2^8$ is subtracted from the result thus obtained. The remainder constitutes temperature data T. Such a temperature measurement circuit has been previously disclosed by the present applicant, and therefore a detailed description will be omitted. T is of course produced as a rounded-off integer.

The temperature data T is again converted into a time duration, by the squaring means of computation circuit 22. If the duration of this time interval is designated as t', then the value of t' is given by the following equation:

$$t'=(T-128)/fF1 \quad (2)$$

In other words, t' is a multiple of the period of the 16 KHz signal F1' which is output from interrupt gate 27. The most significant bit of T is used as the sign bit. With the circuit configuration used for the squaring means of the present embodiment, the following results are obtained:

$$\left.\begin{array}{l} t' = (T-128)^2/fF1\ (T \geqq 128) \\ t' = (T-127)^2/fF1\ (T < 128) \end{array}\right\} \quad (3)$$

The time interval t' serves as a gate time duration during which pulses of the 2 KHz signal F4 are counted, and the resultant count value is given by the following:

$$N=t'/fF4$$

In other words, with the present embodiment:

$$N=(T-128)^2/8 \quad (4)$$

The value of N is rounded off and converted to an integer. If the remaining value left in first counter circuit 22*c* is designated as N1, and that left in second counter circuit 22*d* is designated as N2, then the relationship between N and the numeric data K3 is given by the following:

$$N=K3\times N2+N1 \quad (5)$$

In the above, N1 and N2 are the remainder and the quotient, respectively, produced when N is divided by K3. The compensation amount H1 provided by the first compensation means is given by the following:

$$H1=fSW\times N1/256\ ppm \quad (6)$$

Furthermore, the compensation amount H2 provided by the second compensation means is given by the following:

$$H2=15.26\times N2\ \text{ppm} \quad (7)$$

If the condition is met that:

$$fSW\times K3=15.26\times 256,$$

then the relationship between the resultant overall compensation amount H and N is given by the following equation:

$$\left.\begin{array}{l} H = fSW \times N/256\ \text{ppm} \\ H = 15.26 \times N/K3\ \text{ppm} \end{array}\right\} \quad (8)$$

Since N is a second-order function of T, as shown by equation 4, then by setting T to provide a suitable temperature characteristic by adjustment of numeric data values K1 and K2, the second-order temperature characteristic of the quartz crystal oscillator circuit can be compensated.

In addition, even if fSW is greater than 15.26 ppm, the amplitude of the compensation steps provided by the first compensation means can be set to 15.26 ppm, by adjustment of the value of K3, so as to match the compensation steps provided by the second compensation means. A correct relationship can thereby be established between the first and second compensation means.

In the present embodiment, computation circuit 22 comprises squaring means and division means, together with addition means. Thus, computation circuit 22 can be used to perform timekeeping rate adjustment as well as temperature compensation, as will now be explained. The compensation characteristic provided by temperature compensation circuit 21 is set by the three numeric data values K1, K2 and K3 to be a straight linear characteristic.

In order to move the compensation characteristic in a direction parallel to the frequency axis, so as to establish a resultant frequency deviation of the quartz crystal oscillator circuit output signal of zero, it is necessary to rotate the trimmer capacitor of the quartz crystal oscillator circuit, in the embodiment described above. Using such an adjustment method does not present a problem in the case of a timepiece having a timekeeping accuracy of the order of 10 to 20 seconds of error per month. However in the case of a timepiece having higher timekeeping accuracy, the latter method of adjustment presents a serious problem, with regard to accurately setting the timekeeping rate. If this problem is not resolved, then it will not be possible to attain a sufficiently high degree of accuracy, irrespective of the degree of precision of flatness obtained for the temperature characteristic. For this reason, digital setting means for performing timekeeping rate adjustment, which can be used with the temperature compensation circuit of the present invention will now be described.

Figure 10:
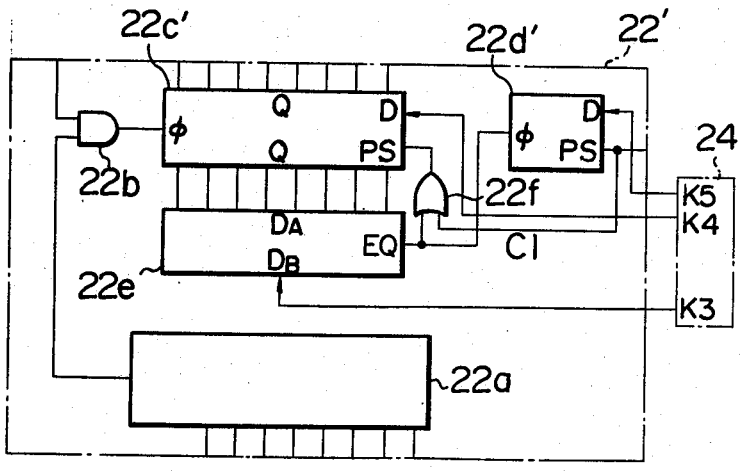
FIG. 10 is a circuit diagram of a modification of part of the circuit of FIG. 9, enabling timekeeping rate adjustment by digital means.

FIG. 10 is a block circuit diagram of a system for meeting the above objective. This is a computation circuit 22', whereby, instead of a first counter 22*c* and second counter circuit 22*d* of the computation circuit 22 of the second embodiment being reset at the start of each computation operation by control signal C1, these counters are preset to separately designated numeric values. The first counter circuit 22*c'* of compensation circuit 22' has data value K4 stored therein at the timing of an output signal from OR gate 22*f*, so that data is preset therein each time a digit carry operation occurs. The second counter circuit 22*d'* is preset with data value K5, just prior to a computation operation, at a timing determined by control signal C1. In this case, the numeric data values which are preset are added to the contents of counters 22*c'* and 22*d'*, so that the amount of compensation provided by the first compensation means and second compensation means is increased by these numeric values over the entire compensation temperature range. Thus, by suitably selecting these numeric data values that are preset into counters 22*c'* and 22*d'*, a temperature compensation characteristic that has been adjusted to be flat can be set to provide a timekeeping deviation of zero. The circuit sections which perform these preset operations overlap the division operation means, to some exent, but can be considered to be addition means. This method of operation, rather than being thought of as a preset method, can be considered to be an addition method, with the numeric data values being added to the contents of first counter circuit 22*c* and second counter circuit 22*d* upon completion of each count operation. The addition means used for this purpose can be provided in duty ratio control circuit 7, or in interrupt circuit 8, rather than being provided in computation circuit 22.

With the present invention, it is of course possible to use a temperature sensing oscillator circuit whose frequency of oscillation varies in direct proportion or in inverse proportion to temperature. Furthermore, the compensation steps produced by the second compensation means are not limited to an amplitude of 15 ppm, so that for example if inversion of the 32 KHz frequency divider circuit signal by the interrupt gate is performed, then compensation steps of 7.63 ppm will be obtained, while if the 8 KHz frequency divider circuit signal is inverted, then compensation steps of 30.52 ppm will be obtained. If the compensation provided by the first compensation means is suitably adjusted to match these different amplitudes of compensation steps, then a system providing the same high degree of temperature compensation accuracy as that obtained with the described embodiment can be implemented.

In addition, the number of bits in the second counter circuit is not limited to 3 bits. For example, if compensation steps of amplitude 7.73 ppm are utilized, then the number of bits of the second counter circuit should be increased.

Thus, an electronic timepiece according to the present invention is provided with first compensation means for controlling the frequency of oscillation of a quartz crystal oscillator circuit, second compensation means for controlling the operation of a frequency divider circuit, and a computation circuit for producing the square of temperature data which varies in approximately direct proportion to temperature, with the most significant digits of the result of this squaring operation being supplied to the second compensation means and the lower significance digits being supplied to the first compensation means, whereby temperature compensation is attained over a wider range of temperatures than has been possible in the prior art. In this way, with the present invention, an electronic timepiece can be produced which will maintain a high degree of timekeeping accuracy, even when left at a very cold temperature, such as in the Antarctic, or left at a very high temperature such as that in an automobile in hot sunshine. This is achieved without the necessity for providing any additional external components to the timepiece IC, thereby enabling such an electronic timepiece to be manufactured at low cost. Thus, the market appeal of an electronic timepiece according to the present invention will be significantly higher than that of a conventional electronic timepiece.

Although the present invention has been described in the above with reference to specific embodiments, the above specification should be interpreted in a descriptive and not in a limiting sense, since various changes and modifications to the described embodiments may be envisaged. The scope claimed for the present invention is laid out in the appended claims.

What is claimed is:

1. An electronic timepiece provided with temperature compensation means, comprising:

a quartz crystal oscillator circuit for producing a standard frequency signal having a frequency versus temperature characteristic which displays second-order curvature;

first control circuit means coupled to said quartz crystal oscillator circuit for controlling the frequency of oscillation thereof;

a frequency divider circuit for performing frequency division of an oscillation signal produced from said quartz crystal oscillator circuit, to thereby produce a unit time signal;

second control circuit means coupled to said frequency divider circuit for controlling the operation thereof such as to control the frequency of said unit time signal;

timekeeping circuit means coupled to receive said unit time signal for producing time information signals, and display means driven in accordance with said time information signals for displaying time information:

memory circuit means for storing a plurality of externally settable data values representing numeric constants;

temperature measurement circuit means for producing temperature data comprising a numeric value which varies in proportion to the operating temperature of said quartz crystal oscillator circuit, said temperature measurement circuit means being coupled to receive at least one of said constant data values from said memory circuit means and operable to modify the value of said temperature data in accordance with said at least one data value; and computation circuit means for computing the square of said temperature data, to thereby produce compensation data having a digital data value, with a plurality of less significant bits of said compensation data constituting first compensation data and a plurality of bits of said compensation data of higher significance than said first compensation data constituting second compensation data;

said first compensation data being applied to said first control circuit means to control the frequency of oscillation of said quartz crystal oscillator circuit in accordance with the value of said first compensation data, and said second compensation data being applied to said second control circuit means to control the frequency of said unit time signal in accordance with the value of said second compensation data.

2. An electronic timepiece according to claim 1, in which said temperature measurement circuit means comprise a temperature sensing oscillator for producing an oscillation signal whose period varies in substantially a linear manner with changes in temperature, and period measurement circuit means for producing said temperature data as a digital value which varies in proportion to said period of said temperature sensing oscillator.

3. An electronic timepiece according to claim 2, in which said period measurement circuit produces a numeric value which varies in proportion to said temperature sensing oscillator signal period, multiplies the latter numeric value by a first data value stored in said memory circuit means and adds to the result of said multiplication operation a second data value stored in said memory circuit means, witih the result of said addition operation consituting said temperature data.

4. An electronic timepiece according to claim 3, in which said first compensation data comprises a plurality of lower significance bits of said compensation data from said computation circuit means, and in which said second compensation data comprises a plurality of bits of said compensation data of higher significance than said first compensation data bits.

5. An electronic timepiece according to claim 3, in which said memory circuit means further stores a third data value, and in which said computation circuit includes divider circuit means for dividing the numeric value resulting from said squaring operation by said third data value, to thereby produce a data value representing the remainder resulting from said division operation and a data value representing the quotient resulting from said division operation, with said remainder data being applied as said first compensation data to said first control means to control the frequency of oscillation of said quartz crystal oscillator circuit and said quotient data being applied as said second compensation data to said second control means to control the period of said unit time signal from said frequency divider circuit.

6. An electronic timepiece according to claim 1, in which said first control means comprise a capacitor, electronic switch means coupled between said capacitor and said quartz crystal oscillator circuit, and duty ratio control circuit means for producing periodically repeated control pulses whose duty ratio is determined by the numeric value represented by said first compensation data, said control pulses being coupled to said electronic switch means for connecting said capacitor to said quartz crystal oscillator circuit for the duration of each of said control pulses.

7. An electronic timepiece according to claim 1, in which said second control means comprise an interrupt gate circuit coupled between stages of said frequency divider circuit, and interrupt circuit means for generating control pulses during cyclically repeated intervals, with the number of said control pulses generated during each of said intervals being determined by the numeric value represented by said second compensation data, each of said control pulses acting on said interrupt gate circuit to invert a frequency divider signal transferred therethrough.

8. An electronic timepiece according to claim 2, in which said temperature sensing oscillator comprises a plurality of MOS field effect transistors formed within a common integrated circuit chip with circuit components of said quartz crystal oscillator circuit and said timekeeping circuit means.

9. An electronic timepiece according to claim 1, and further comprising compensation data register means provided between said computation circuit means and said first control circuit means and between said computation circuit means and said second control circuit means, for temporarily storing said first compensation data and said second compensation data from said computation circuit means.

10. An electronic timepiece according to claim 9, and further comprising addition circuit means coupled to said compensation data register means, for adding a first data value from said memory circuit means to said first compensation data and adding a second data value from said memory circuit means to said second compensation data, with said first and second data values being set by external means such that an overall amount of frequency compensation applied in response to said first and second compensation data results in a predetermined period of said unit time signal and hence a predetermined timekeeping rate of said timepiece being attained.

* * * * *